US008785362B2

(12) United States Patent
Penninger et al.

(10) Patent No.: US 8,785,362 B2
(45) Date of Patent: Jul. 22, 2014

(54) TRIAZINE DERIVATIVE DYE TRANSFER INHIBITORS, WASHING PRODUCTS CONTAINING THE SAME AND USES THEREFOR

(75) Inventors: Josef Penninger, Hilden (DE); Birgit Glüsen, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 462 days.

(21) Appl. No.: 13/430,769

(22) Filed: Mar. 27, 2012

(65) Prior Publication Data

US 2012/0196785 A1 Aug. 2, 2012

Related U.S. Application Data

(62) Division of application No. 12/064,107, filed as application No. PCT/EP2006/007772 on Aug. 5, 2006.

(30) Foreign Application Priority Data

Aug. 19, 2005 (DE) ..... 10 2005 039 580

(51) Int. Cl.
*C11D 3/00* (2006.01)

(52) U.S. Cl.
USPC ..... 510/300

(58) Field of Classification Search
USPC ..... 510/300
See application file for complete search history.

(56) References Cited

U.S. PATENT DOCUMENTS

| | | | | |
|---|---|---|---|---|
| 3,234,258 | A | | 2/1966 | Morris |
| 3,817,702 | A | | 6/1974 | Paulus et al. |
| 3,947,374 | A | | 3/1976 | Loffelman et al. |
| 4,585,642 | A | | 4/1986 | Rieck |
| 4,755,319 | A | | 7/1988 | Smolka et al. |
| 4,820,439 | A | | 4/1989 | Rieck |
| 4,898,621 | A | | 2/1990 | Pruehs et al. |
| 4,985,553 | A | | 1/1991 | Fuertes et al. |
| 5,075,041 | A | | 12/1991 | Lutz |
| 5,183,651 | A | | 2/1993 | Schimmel et al. |
| 5,236,682 | A | | 8/1993 | Schimmel et al. |
| 5,268,156 | A | | 12/1993 | Schimmel et al. |
| 5,281,707 | A | | 1/1994 | Fuso et al. |
| 5,308,596 | A | | 5/1994 | Kotzian et al. |
| 5,356,607 | A | | 10/1994 | Just et al. |
| 5,382,377 | A | | 1/1995 | Raehse et al. |
| 5,494,488 | A | | 2/1996 | Arnoldi et al. |
| 5,541,316 | A | | 7/1996 | Engelskirchen et al. |
| 5,542,951 | A | | 8/1996 | Antwerpen et al. |
| 5,569,645 | A | * | 10/1996 | Dinniwell et al. ..... 510/276 |
| 5,571,444 | A | | 11/1996 | Fisher et al. |
| 5,578,667 | A | | 11/1996 | Fuso et al. |
| 5,607,618 | A | | 3/1997 | Antwerpen et al. |
| 5,616,550 | A | | 4/1997 | Kruse et al. |
| 5,677,384 | A | | 10/1997 | Detering et al. |
| 5,798,328 | A | | 8/1998 | Kottwitz et al. |
| 5,830,956 | A | | 11/1998 | Stockhausen et al. |
| 5,846,924 | A | | 12/1998 | Detering et al. |
| 5,854,321 | A | | 12/1998 | Krause et al. |
| 5,880,252 | A | | 3/1999 | Kim et al. |
| 5,922,670 | A | | 7/1999 | Knuebel et al. |
| 5,922,865 | A | | 7/1999 | Adam et al. |
| 5,972,668 | A | | 10/1999 | Georg et al. |
| 6,015,784 | A | | 1/2000 | Kazuta et al. |
| 6,075,001 | A | | 6/2000 | Wilde |
| 6,462,006 | B1 | | 10/2002 | Sorg et al. |
| 2002/0147126 | A1 | | 10/2002 | Sivik et al. |

FOREIGN PATENT DOCUMENTS

| | | | |
|---|---|---|---|
| AU | 61514/90 | B | 4/1991 |
| CH | 541024 | A | 10/1973 |
| DE | 1962899 | A1 | 6/1971 |
| DE | 2412837 | B2 | 10/1974 |
| DE | 2814287 | A1 | 10/1979 |
| DE | 2814329 | A1 | 10/1979 |
| DE | 3803630 | A1 | 8/1989 |
| DE | 4221381 | C1 | 2/1994 |
| DE | 4300772 | C2 | 7/1994 |
| DE | 4303320 | C2 | 8/1994 |
| DE | 4321022 | A1 | 1/1995 |
| DE | 4328254 | A1 | 3/1995 |
| DE | 4417734 | A1 | 11/1995 |
| DE | 4443177 | A1 | 6/1996 |
| DE | 19503061 | A1 | 8/1996 |
| DE | 19513391 | A1 | 10/1996 |
| DE | 19616693 | A1 | 11/1997 |
| DE | 19616767 | A1 | 11/1997 |
| DE | 19616769 | A1 | 11/1997 |
| DE | 19616770 | A1 | 11/1997 |
| DE | 19819187 | A1 | 11/1999 |

(Continued)

OTHER PUBLICATIONS

Rieck, H.-P. "Everyday products with high-tech dimensions", Hoechst High Chem Magazine, 1993, vol. 14, pp. 33-38.

(Continued)

*Primary Examiner* — Ling Choi
*Assistant Examiner* — Thuy-Ai Nguyen
(74) *Attorney, Agent, or Firm* — Thomas G. Krivulka

(57) ABSTRACT

Washing products comprising a dye transfer inhibitor selected from triazine derivatives of the general formulae $T(NH—Ar(SO_3Na)_a)_bHal_c$ (I), $X(NH\text{-}T(NH—Ar(SO_3Na)_a)_eHal_f)_2$ (II), $X(NH\text{-}T(NH—Ar(SO_3Na)_d—NH\text{-}T(NH—Ar(SO_3Na)_a)Hal)Hal)_7$ (III) and combinations thereof, wherein T represents a 1,3,5-triazinyl; each Ar independently represents a naphthalene or benzene; X represents a divalent hydrocarbyl selected from linear or branched $C_{1-20}$ hydrocarbon groups optionally including one or more —N(H)— carbon chain interruptions, stilbene and biphenyl groups which may optionally be mono- or poly-$SO_3Na$-substituted; each Hal independently represents a halogen selected chlorine, bromine, and iodine; each of a and d independently represents 1, 2 or 3; b and c each represent 1 or 2 such that b+c=3; e represents 1 or 2 and f represents 0 or 1 such that e+f=2; and wherein the triazinyl substituents are located at the 2, 4 and 6 positions of the 1,3,5-triazinyl.

14 Claims, No Drawings

(56) References Cited

FOREIGN PATENT DOCUMENTS

| | | | |
|---|---|---|---|
| EP | 0164514 | B1 | 12/1985 |
| EP | 0164552 | B1 | 12/1985 |
| EP | 0232202 | B1 | 8/1987 |
| EP | 0135217 | B1 | 2/1988 |
| EP | 0262897 | A2 | 4/1988 |
| EP | 0294753 | B1 | 12/1988 |
| EP | 0300305 | B1 | 1/1989 |
| EP | 0425427 | B1 | 5/1991 |
| EP | 0436835 | B1 | 7/1991 |
| EP | 0446982 | B1 | 9/1991 |
| EP | 0452428 | B1 | 10/1991 |
| EP | 0453003 | B1 | 10/1991 |
| EP | 0486592 | B1 | 5/1992 |
| EP | 0502325 | B1 | 9/1992 |
| EP | 0525239 | B1 | 2/1993 |
| EP | 0642576 | B1 | 3/1993 |
| EP | 0548599 | B1 | 6/1993 |
| EP | 0564476 | B1 | 10/1993 |
| EP | 0584709 | B1 | 3/1994 |
| EP | 0610846 | B1 | 8/1994 |
| EP | 0625992 | B1 | 11/1994 |
| EP | 0584738 | B1 | 4/1998 |
| JP | 58-217598 | A | 12/1983 |
| JP | 4-238809 | A | 8/1992 |
| JP | 4-260610 | A | 9/1992 |
| WO | WO-90/13533 | A1 | 11/1990 |
| WO | WO-91/05839 | A1 | 5/1991 |
| WO | WO-91/08171 | A1 | 6/1991 |
| WO | WO-92/18542 | A1 | 10/1992 |
| WO | WO-92/18687 | A1 | 10/1992 |
| WO | WO-94/02579 | A1 | 2/1994 |
| WO | WO-94/10281 | A1 | 5/1994 |
| WO | WO-94/23005 | A1 | 10/1994 |
| WO | WO-94/26796 | A1 | 11/1994 |
| WO | WO-94/27970 | A1 | 12/1994 |
| WO | WO-94/28102 | A1 | 12/1994 |
| WO | WO-94/28103 | A1 | 12/1994 |
| WO | WO-94/29422 | A1 | 12/1994 |
| WO | WO-95/00626 | A1 | 1/1995 |
| WO | WO-95/03382 | A1 | 2/1995 |
| WO | WO-95/03388 | A1 | 2/1995 |
| WO | WO-95/06098 | A1 | 3/1995 |
| WO | WO-95/07331 | A1 | 3/1995 |
| WO | WO-95/09194 | A1 | 4/1995 |
| WO | WO-95/13354 | A1 | 5/1995 |
| WO | WO-95/14075 | A1 | 5/1995 |
| WO | WO-95/14759 | A1 | 6/1995 |
| WO | WO-95/17498 | A1 | 6/1995 |
| WO | WO-95/19953 | A1 | 7/1995 |
| WO | WO-95/19954 | A1 | 7/1995 |
| WO | WO-95/19955 | A1 | 7/1995 |
| WO | WO-95/22592 | A1 | 8/1995 |
| WO | WO-96/00772 | A1 | 1/1996 |
| WO | WO-96/00773 | A1 | 1/1996 |
| WO | WO-96/10079 | A1 | 4/1996 |
| WO | WO-96/12845 | A1 | 5/1996 |
| WO | WO-96/12846 | A1 | 5/1996 |

OTHER PUBLICATIONS

Dany, F.-J., et al., "Kristallines schichtsilikat—ein neuer builder", Seifen-Öle-Fette-Wachse, 1990, vol. 116, No. 20, pp. 805-808.

"Antimicrobial fabrics containing mycerin combined with sulfo groups of modified cellulose", Database CA, Accession No. 69:37013, May 12, 1984.

* cited by examiner

TRIAZINE DERIVATIVE DYE TRANSFER INHIBITORS, WASHING PRODUCTS CONTAINING THE SAME AND USES THEREFOR

CROSS-REFERENCE TO RELATED APPLICATIONS

This application is a division of U.S. application Ser. No. 12/064,107, which is incorporated by reference in its entirety and which is a national stage application, under 35 U.S.C. §371, of PCT/EP2006/007772, filed Aug. 5, 2006, which claims priority of German Application No. 10 2005 039 580.5, filed Aug. 19, 2005.

The present invention relates to the use of sulfonated triazine derivatives as dye transfer-inhibiting active ingredients in the washing of textiles and to washing products which contain such compounds.

In addition to the constituents essential for the washing process such as surfactants and builders, washing products generally contain further ingredients which may be grouped together under the heading of washing auxiliaries and thus include various groups of active ingredients such as foam regulators, graying inhibitors, bleaching agents, bleaching activators and enzymes. Such auxiliary substances also include substances which are intended to prevent dyed textiles from having a modified color appearance after washing. This change in color appearance of washed, i.e. clean, textiles may be due, on the one hand, to proportions of the dye being removed from the textile by the washing process ("fading"), and, on the other hand, to dyes dissolved out from differently colored textiles being deposited on the textile ("discoloration"). Change of the discoloration kind may also involve undyed items of washing if these are washed together with colored items of washing. In order to avoid these undesired side-effects of removing dirt from textiles by treatment with conventionally surfactant-containing aqueous systems, washing products, especially when they are intended as "color" washing products for washing colored textiles, contain active ingredients which are intended to prevent the dissolution of dyes from the textile or at least the deposition of dissolved-out dyes present in the washing liquor onto textiles. Many of the polymers conventionally used have such a high affinity for dyes that they draw them to a greater extent from the dyed fiber, such that greater color losses occur.

BRIEF SUMMARY OF THE INVENTION

It has surprisingly now been found that specific sulfonated triazine derivatives give rise to unexpectedly high dye transfer inhibition if they are used in washing products. The preventive action against the staining of white or also differently colored textiles by dyes washed out of the textiles is particularly pronounced. It is conceivable that the triazine derivatives, which are specified in greater detail below, attach themselves to the textiles during washing and, possibly due to their sulfonic acid group content, have a repellent action on the dye molecules present in the liquor.

The present invention accordingly provides the use of triazine derivatives of the general formulae I, II or Ill, $$T(NH—Ar(SO_3Na)_a)_bHal_c \quad (I)$$

$$X(NH\text{-}T(NH—Ar(SO_3Na)_a)_eHal_f)_2 \quad (II)$$

in which

T denotes a 1,3,5-triazinyl residue,

Ar denotes a naphthalene or benzene grouping,

X denotes a linear or branched carbon chain, optionally interrupted by NH groups, having 1 to 20, in particular 2 to 12, C atoms or an optionally mono- or poly-$SO_3Na$-substituted stilbene or biphenyl grouping, Hal denotes chlorine, bromine or iodine, a and d mutually independently denote 1, 2 or 3, b denotes 1 and c denotes 2 or b denotes 2 and c denotes 1, e denotes 1 and f denotes 1 or e denotes 2 and f denotes 0, and the —NH substituents, like the -Hal substituents, are located in positions 2, 4 and 6 of the triazinyl ring, in order to avoid the transfer of textile dyes from dyed textiles onto undyed or differently colored textiles when they are jointly washed in aqueous solutions, in particular surfactant-containing aqueous solutions.

The present invention also provides a color protection washing product containing a dye transfer inhibitor in the form of a triazine derivative of the above-stated general formula I, II or III in addition to conventional constituents compatible with this ingredient.

DETAILED DESCRIPTION OF THE INVENTION

Triazine derivatives of the general formula I are obtainable by reacting 2,4,6-trihalo-1,3,5-triazines with 1 or 2 equivalents of aminoaryl compound, the aryl group of the aminoaryl compound being a mono- to tri-sulfonate-substituted benzene or naphthalene unit. Aminoaryl compounds which may be considered are, for example, 2-aminobenzenesulfonic acid, 3-aminobenzenesulfonic acid, 4-aminobenzenesulfonic acid, 2-amino-1,3-benzenedisulfonic acid, 4-amino-1,3-benzenedisulfonic acid, 2-amino-1,3,5-benzenetrisulfonic acid, 2-amino-1-naphthalenesulfonic acid, 3-amino-1-naphthalenesulfonic acid, 4-amino-1-naphthalenesulfonic acid, 2-amino-1,5-naphthalenedisulfonic acid, 7-amino-1,6-naphthalenedisulfonic acid, 2-amino-3,6,8-naphthalenetrisulfonic acid and 7-amino-1,3,6-naphthalenetrisulfonic acid, their sulfonic acid groups assuming salt form. Mixtures of the stated aminoaryl compounds may also be used.

Compounds of the formula II are obtained by reacting 2 equivalents of such compounds according to formula I, which still bear 1 or 2 halogens on the triazine residue, with 1 equivalent of $C_{1-20}$-diaminoalkane, diaminostilbene or diaminobiphenyl ($H_2N—X—NH_2$). Particularly preferred diaminoalkanes are α,ω-diaminoalkanes, but oligo- or polyethyleneimines or -propyleneimines may also be considered; preferred oligo- or polyethyleneimines are those of the formula $NH_2—CH_2CH_2—(NH—CH_2CH_2—)_nNH_2$, in which n is a number from 1 to 9, in particular 2 to 5, it also being possible to use mixtures of oligo- or polyethyleneimines of different degrees of oligomerization or polymerization, such that, is an average value, n may assume non-integral values. It is preferred if the diaminostilbene or diaminobiphenyl also additionally comprises at least 1, in particular 2, sulfonic acid salt substituents, such as for example 4,4'-diamino-2,2'-biphenyldisulfonic acid disodium salt or 4,4'-diamino-2,2'-stilbendisulfonic acid disodium salt. The stilbenes preferably comprise stilbenes in trans-configuration, it optionally also being possible to use stilbenes in cis-configuration and mixtures thereof. Mixtures of diaminostilbenes with diaminobiphenyls may also be used.

Corresponding diaminoalkanes, diaminostilbenes or diaminobiphenyls, reacted with 2 equivalents of 2,4,6-trihalo-1,3,5-triazine, the reaction product then reacted with 2 equivalents of a diaminoaryl compound $H_2N—Ar(SO_3Na)_d—NH_2$, the resultant reaction product in turn reacted with 2 equivalents of 2,4,6-trihalo-1,3,5-triazine and then with 2 equivalents of aminoaryl compound, yield compounds according to the general formula III. The aminoaryl compound is here identical with the aminoaryl compound mentioned in the production of the compound according to the formula I. The diaminoaryl compound is selected from among compounds which entirely correspond in terms of the parent structure and which additionally bear a second amino group.

When simultaneously using different aminoaryl compounds or when simultaneously using different diaminoaryl compounds or when simultaneously using different diaminoalkanes and/or optionally different substituted diaminostilbenes and/or diaminobiphenyls, the described production process arbitrarily gives rise to compounds according to the formula I, II or III, in which the particular variables a, b, c, d, e, f, X and Ar are in each case not always identical.

A product according to the invention preferably contains 0.05 wt. % to 2 wt. %, in particular 0.2 wt. % to 1 wt. %, of dye transfer-inhibiting compound of the general formula I, II and/or III. The "and/or" wording is intended to make it clear that it is also possible to make joint use of compounds which in each case correspond to one of the stated formulae.

The compounds of the general formula I, II or III make a contribution to both of the above-mentioned aspects of color consistency, i.e. they reduce both discoloration and fading, although the staining prevention effect, in particular when washing white textiles, is most pronounced. The present invention accordingly also provides the use of a corresponding compound for avoiding the modification of the color appearance of textiles when they are washed in aqueous solutions, in particular surfactant-containing aqueous solutions. A modification of the color appearance should in no event here be taken to mean the difference between the dirty and the clean textile, but instead the difference between the clean textile in each case before and after the washing operation.

The present invention also provides a method for washing dyed textiles in surfactant-containing aqueous solutions, wherein a surfactant-containing aqueous solution is used which contains a compound of the general formula I, II or III. In such a method, it is possible also to wash white or undyed textiles together with the dyed textile without the white or undyed textile being stained.

A product according to the invention may, in addition to the compound according to formula (I), (II) or (III), contain a known dye transfer inhibitor, preferably in quantities of 0.1 wt. % to 2 wt. %, in particular 0.2 wt. % to 1 wt. %, said inhibitor being in a preferred development of the invention a polymer of vinylpyrrolidone, vinylimidazole, vinylpyridine N-oxide or a copolymer thereof. Usable compounds are not only the polyvinylpyrrolidones with a molecular weight of 15,000 to 50,000 known for example from European patent application EP 0 262 897 but also the polyvinylpyrrolidones with a molecular weight of above 1,000,000, in particular of 1,500,000 to 4,000,000, known from international patent application WO 95/06098, the N-vinylimidazole/N-vinylpyrrolidone copolymers known from German patent applications DE 28 14 287 or DE 38 03 630 or from international patent applications WO 94/10281, WO 94/26796, WO 95/03388 and WO 95/03382, the polyvinyloxazolidones known from German patent application DE 28 14 329, the copolymers based on vinyl monomer and carboxamides known from European patent application EP 610 846, the polyesters and polyamides containing pyrrolidone groups known from international patent application WO 95/09194, the grafted polyamidoamines and polyethyleneimines known from international patent application WO 94/29422, the polymers with amide groups from secondary amines known from German patent application DE 43 28 254, the polyamine N-oxide polymers known from international patent application WO 94/02579 or European patent application EP 0 135 217, the polyvinyl alcohols known from European patent application EP 0 584 738 and the copolymers based on acrylamidoalkenylsulfonic acids known from European patent application EP 0 584 709. It is, however, also possible to use enzymatic systems comprising a peroxidase and hydrogen peroxide or a substance which releases hydrogen peroxide in water, as are known for example from international patent applications WO 92/18687 and WO 91/05839. The addition of a mediator compound for the peroxidase, for example an acetosyringone known from international patent application WO 96/10079, a phenol derivative known from international patent application WO 96/12845 or a phenothiazine or phenoxazine known from international patent application WO 96/12846, is preferred in this case, it also additionally being possible to use the above-stated polymeric dye transfer inhibitor active ingredients. For use in products according to the invention, polyvinylpyrrolidone preferably has an average molar mass in the range from 10,000 to 60,000, in particular in the range from 25,000 to 50,000. Preferred copolymers are those prepared from vinylpyrrolidone and vinylimidazole in the molar ratio 5:1 to 1:1 having an average molar mass in the range from 5,000 to 50,000, in particular 10,000 to 20,000.

The washing products according to the invention, which may in particular assume the form of pulverulent solids, post-compacted particles, homogeneous solutions or suspensions, may in principle, apart from the active ingredient used according to the invention, contain any constituents which are known and conventional in such products. The products according to the invention may in particular contain builder substances, surface-active surfactants, bleaching agents based on organic and/or inorganic peroxy compounds, bleaching activators, water-miscible organic solvents, enzymes, sequestering agents, electrolytes, pH regulators and further auxiliary materials, such as optical brighteners, graying inhibitors, foam regulators together with colorants and fragrances.

The products according to the invention may contain one surfactant or two or more surfactants, it being possible in particular to consider not only anionic surfactants, nonionic surfactants and mixtures thereof, but also cationic, zwitterionic and amphoteric surfactants.

Suitable nonionic surfactants are in particular alkylglycosides and ethoxylation and/or propoxylation products of alkylglycosides or linear or branched alcohols in each case having 12 to 18 C atoms in the alkyl moiety and 3 to 20, preferably 4 to 10, alkyl ether groups. Corresponding ethoxylation and/or propoxylation products of N-alkylamino, vicinal diols, fatty acid esters and fatty acid amides, which correspond with regard to the alkyl moiety to the stated long-chain alcohol derivatives, and of alkylphenols having 5 to 12 C atoms in the alkyl residue may furthermore be used.

Preferably used nonionic surfactants are alkoxylated, advantageously ethoxylated, in particular primary alcohols with preferably 8 to 18 C atoms and on average 1 to 12 mol of ethylene oxide (EO) per mol of alcohol, in which the alcohol residue may be linear or preferably methyl-branched in position 2 or may contain linear and methyl-branched residues in the mixture, as are convetionally present in oxo alcohol residues. In particular, however, alcohol ethoxylates with linear residues prepared from alcohols of natural origin with 12 to 18 C atoms, for example from coconut, palm, tallow fat or oleyl alcohol, and on average 2 to 8 EO per mol of alcohol are preferred. Preferred ethoxylated alcohols include, for example, $C_{12}$-$C_{14}$ alcohols with 3 EO or 4 EO, $C_9$-$C_{11}$ alcohols with 7 EO, $C_{13}$-$C_{15}$ alcohols with 3 EO, 5 EO, 7 EO or 8 EO, $C_{12}$-$C_{18}$ alcohols with 3 EO, 5 EO or 7 EO and mixtures of these, such as mixtures of $C_{12}$-$C_{14}$ alcohol with 3 EO and $C_{12}$-$C_{18}$ alcohol with 7 EO. The stated degrees of ethoxylation are statistical averages which, for a specific product, may be an integer or a fractional number. Preferred alcohol ethoxylates have a narrow homologue distribution (narrow range ethoxylates, NRE). In addition to these nonionic surfactants, fatty alcohols with more than 12 EO may also be used. Examples of these are (tallow) fatty alcohols with 14 EO, 16 EO, 20 EO, 25 EO, 30 EO or 40 EO. In particular in products for use in machine washing, extremely low-foam compounds are conventionally used. These preferably include $C_{12}$-$C_{18}$ alkylpolyethylene glycol/polypropylene glycol ethers in each case having up to 8 mol of ethylene oxide and propylene oxide units per molecule. It is, however, also possible to use other nonionic surfactants which are known to be low-foaming, such as for example $C_{12}$-$C_{18}$-alkyl polyethylene glycol/polybutylene glycol ethers with in each case up to 8 mol ethylene oxide and butylene oxide units per molecule and end group-terminated alkylpolyalkylene glycol mixed ethers. The alkoxylated alcohols containing hydroxyl groups as described in European patent application EP 0 300 305, or "hydroxy mixed ethers", are also particularly preferred. Alkylglycosides of the general formula $RO(G)_x$, in which R means a primary linear or methyl-branched aliphatic residue, in particular methyl-branched in position 2, with 8 to 22, preferably 12 to 18 C atoms, and G denotes a glycose unit with 5 or 6 C atoms, preferably glucose, may also be used as nonionic surfactants. The degree of oligomerization x, which indicates the distribution of monoglycosides and oligoglycosides, is any desired number and, being an analytically determined variable, may also assume fractional values between 1 and 10; x is preferably 1.2 to 1.4. Polyhydroxyfatty acid amides of the formula (IV) are likewise suitable, in which $R^1CO$ denotes an aliphatic acyl residue with 6 to 22 carbon atoms, $R^2$ denotes hydrogen, an alkyl or hydroxyalkyl residue with 1 to 4 carbon atoms and [Z] denotes a linear or branched polyhydroxyalkyl residue with 3 to 10 carbon atoms and 3 to 10 hydroxyl groups:

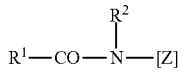

(IV)

The polyhydroxyfatty acid amides are preferably derived from reducing sugars with 5 or 6 carbon atoms, in particular from glucose. The group of polyhydroxyfatty acid amides also includes compounds of the formula (V),

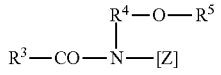

(V)

in which $R^3$ denotes a linear or branched alkyl or alkenyl residue with 7 to 12 carbon atoms, $R^4$ denotes a linear, branched or cyclic alkylene residue or an arylene residue with 2 to 8 carbon atoms and $R^5$ denotes a linear, branched or cyclic alkyl residue or an aryl residue or an oxyalkyl residue with 1 to 8 carbon atoms, $C_1$-$C_4$ alkyl or phenyl residues being preferred, and [Z] denotes a linear polyhydroxyalkyl residue, the alkyl chain of which is substituted with at least two hydroxyl groups, or alkoxylated, preferably ethoxylated or propoxylated, derivatives of this residue. [Z] is also here preferably obtained by reductive amination of a sugar such as glucose, fructose, maltose, lactose, galactose, mannose or xylose. The N-alkoxy- or N-aryloxy-substituted compounds may then be converted into the desired polyhydroxyfatty acid amides, for example according to the teaching of international patent application WO 95/07331, by reaction with fatty acid methyl esters in the presence of an alkoxide as catalyst. A further class of preferably used nonionic surfactants, which are used either as sole nonionic surfactant or in combination with other nonionic surfactants, in particular together with alkoxylated fatty alcohols and/or alkyl glycosides, are alkoxylated, preferably ethoxylated or ethoxylated and propoxylated fatty acid alkyl esters, preferably with 1 to 4 carbon atoms in the alkyl chain, in particular fatty acid methyl esters, as are for example described in Japanese patent application JP 58/217598 or which are preferably produced in accordance with the process described in international patent application WO 90/13533. Nonionic surfactants of the amine oxide type, for example N-coconut alkyl-N,N-dimethylamine oxide and N-tallow alcohol-N,N-dihydroxyethylamine oxide, and the fatty acid alkanolamide type may also be suitable. The quantity of these nonionic surfactants preferably amounts to no more than that of the ethoxylated fatty alcohols, in particular no more than half the quantity thereof. "Gemini" surfactants may also be considered as further surfactants. These are generally taken to mean such compounds as have two hydrophilic groups per molecule. These groups are generally separated from one another by a "spacer". This spacer is generally a carbon chain which should be long enough for the hydrophilic groups to be sufficiently far apart that they can act mutually independently. Such surfactants are in general distinguished by an unusually low critical micelle concentration and the ability to bring about a great reduction in the surface tension of water. In exceptional cases, gemini surfactants include not only such "dimeric" surfactants, but also corresponding "trimeric" surfactants. Suitable gemini surfactants are, for example, sulfated hydroxy mixed ethers according to German patent application DE 43 21 022 or dimer alcohol bis- and trimer alcohol tris-sulfates and -ether sulfates according to German patent application DE 195 03 061. End group-terminated dimeric and trimeric mixed ethers according to German patent application DE 195 13 391 are in particular distinguished by their di- and multifunctionality. The stated end group-terminated surfactants accordingly exhibit good wetting characteristics and are low-foaming, such that they are in particular suitable for use in machine washing or cleaning processes. Gemini polyhydroxyfatty acid amides or polypolyhydroxyfatty acid amides, as are described in international patent applications WO 95/19953, WO 95/19954 and WO 95/19955, may, however, also be used.

Suitable anionic surfactants are in particular soaps and those which contain sulfate or sulfonate groups. Surfactants of the sulfonate type which may preferably be considered are $C_9$-$C_{13}$ alkyl benzene sulfonates, olefin sulfonates, i.e. mixtures of alkene and hydroxyalkane sulfonates and disulfonates, as are obtained, for example, from $C_{12}$-$C_{18}$ monoolefins with a terminal or internal double bond by sulfonation with gaseous sulfur trioxide and subsequent alkaline or acidic hydrolysis of the sulfonation products. Alkane sulfonates which are obtained from $C_{12}$-$C_{18}$ alkanes for example by sulfochlorination or sulfoxidation with subsequent hydrolysis or neutralization are also suitable. The esters of α-sulfofatty acids (ester sulfonates), for example the α-sulfonated methyl esters of hydrogenated coconut, palm kernel or tallow fatty acids, which are produced by α-sulfonation of the methyl esters of fatty acids of vegetable and/or animal origin with 8 to 20 C atoms in the fatty acid molecule and subsequent neutralization to yield water-soluble mono salts, may also be considered suitable. The α-sulfonated esters of hydrogenated coconut, palm, palm kernel or tallow fatty acids are here preferred, it also being possible for sulfonation products of unsaturated fatty acids, for example oleic acid, also to be present in small quantities, preferably in quantities of no more than approx. 2 to 3 wt. %. Preferred α-sulfofatty acid alkyl esters are in particular those which comprise an alkyl chain with no more than 4 C atoms in the ester group, for example methyl ester, ethyl ester, propyl ester and butyl ester. The methyl esters of α-sulfofatty acids (MES), and the saponified disalts thereof too, are particularly advantageously used. Further suitable anionic surfactants are sulfated fatty acid glycerol esters, which are mono-, di- and triesters and mixtures thereof, as are obtained during production by esterification by a monoglycerol with 1 to 3 mol of fatty acid or on transesterification of triglycerides with 0.3 to 2 mol of glycerol. Preferred alk(en)yl sulfates are the alkali metal and in particular sodium salts of sulfuric acid semi-esters of $C_{12}$-$C_{18}$ fatty alcohols for example prepared from coconut fatty alcohol, tallow fatty alcohol, lauryl, myristyl, cetyl- or stearyl alcohol or $C_{10}$-$C_{20}$ oxo alcohols and those semi-esters of secondary alcohols of this chain length. Alk(en)yl sulfates of the stated chain length which contain a synthetic linear alkyl residue produced on a petrochemical basis and which exhibit degradation behavior similar to that of the appropriate compounds based on fatty chemical raw materials are also preferred. In particular, $C_{12}$-$C_{16}$ alkyl sulfates and $C_{12}$-$C_{15}$ alkyl sulfates and $C_{14}$-$C_{15}$ alkyl sulfates are preferred because of their washing characteristics. 2,3-Alkyl sulfates, which are produced, for example, according to American patents U.S. Pat. No. 3,234,258 or U.S. Pat. No. 5,075,041 and may be obtained as commercial products of Shell Oil Company under the name DAN®, are also suitable anionic surfactants. The sulfuric acid monoesters of linear or branched $C_7$-$C_{21}$ alcohols ethoxylated with 1 to 6 mol of ethylene oxide are also suitable, such as 2-methyl-branched $C_9$-$C_{11}$ alcohols with on average 3.5 mol of ethylene oxide (EO) or $C_{12}$-$C_{18}$ fatty alcohols with 1 to 4 EO. Preferred anionic surfactants also include the salts of alkylsulfosuccinic acid, which are also known as sulfosuccinates or sulfosuccinic acid esters, and are the monoesters and/or diesters of sulfosuccinic acid with alcohols, preferably fatty alcohols and in particular ethoxylated fatty alcohols. Preferred sulfosuccinates contain $C_8$ to $C_{18}$ fatty alcohol residues or mixtures thereof. Particularly preferred sulfosuccinates contain a fatty alcohol residue which is derived from ethoxylated fatty alcohols, which are in themselves nonionic surfactants. Sulfosuccinates whose fatty alcohol residues are derived from ethoxylated fatty alcohols with a narrow homologue distribution are here particularly preferred. It is likewise also possible to use alk(en)ylsuccinic acid with preferably 8 to 18 carbon atoms in the alk(en)yl chain or the salts thereof. Further anionic surfactants which may be considered are fatty acid derivatives of amino acids, for example of N-methyltaurine (taurides) and/or of N-methylglycine (sarcosides). Sarcosides or sarcosinates are particularly preferred here and most especially sarcosinates of higher and optionally mono- or polyunsaturated fatty acids such as oleyl sarcosinate. Further anionic surfactants which may in particular be considered are soaps. Saturated fatty acid soaps are in particular suitable, such as the salts of lauric acid, myristic acid, palmitic acid, stearic acid, hydrogenated erucic acid and behenic acid and in particular soap mixtures derived from natural fatty acids, for example coconut, palm kernel or tallow fatty acids. Known alkenylsuccinic acid salts may also be used together with these soaps or as substitutes for soaps.

The anionic surfactants, including the soaps, may be present in the form of the sodium, potassium or ammonium salts thereof and as soluble salts of organic bases, such as mono-, di- or triethanolamine. The anionic surfactants are preferably present in the form of the sodium or potassium salts thereof, in particular in the form of the sodium salts.

Surfactants are present in washing products according to the invention in proportions of preferably 5 wt. % to 50 wt. %, in particular of 8 wt. % to 30 wt. %.

A product according to the invention preferably contains at least one water-soluble and/or water-insoluble, organic and/or inorganic builder. The water-soluble organic builder substances include polycarboxylic acids, in particular citric acid and saccharic acids, monomeric and polymeric aminopolycarboxylic acids, in particular methylglycinediacetic acid, nitrilotriacetic acid and ethylenediaminetetraacetic acid and polyaspartic acid, polyphosphonic acids, in particular aminotris(methylenephosphonic acid), ethylenediaminetetrakis(methylenephosphonic acid) and 1-hydroxyethyl-1,1-diphosphonic acid, polymeric hydroxy compounds such as dextrin and polymeric(poly)carboxylic acids, in particular the polycarboxylates obtainable by oxidation of polysaccharides or dextrins of European patent EP 0 625 992 or international patent application WO 92/18542 or European patent EP 0 232 202, polymeric acrylic acids, methacrylic acids, maleic acids and copolymers thereof, which may also contain small proportions of polymerizable substances without carboxylic acid functionality incorporated therein by polymerization. The relative molecular mass of the homopolymers of unsaturated carboxylic acids is in general between 3,000 and 200,000, that of the copolymers between 2,000 and 200,000, preferably 30,000 to 120,000, in each case relative to free acid. One particularly preferred acrylic acid/maleic acid copolymer has a relative molecular mass of 30,000 to 100,000. Conventional commercial products are for example Sokalan® CP 5, CP 10 and PA 30 from BASF. Suitable, albeit less preferred, compounds of this class are copolymers of acrylic acid or methacrylic acid with vinyl ethers, such as vinyl methyl ethers, vinyl esters, ethylene, propylene and styrene, the acid fraction of which amounts to at least 50 wt. %. Terpolymers containing as monomers two unsaturated acids and/or the salts thereof and, as third monomer, vinyl alcohol and/or a esterified vinyl alcohol or a carbohydrate may also be used as water-soluble organic builder substances. The first acidic monomer or the salt thereof is derived from a monoethylenically unsaturated $C_3$-$C_8$-carboxylic acid and preferably from a $C_3$-$C_4$-monocarboxylic acid, in particular from (meth) acrylic acid. The second acidic monomer or the salt thereof may be a derivative of a $C_4$-$C_8$-dicarboxylic acid, maleic acid being particularly preferred, and/or a derivative of an allylsulfonic acid which is substituted in position 2 with an alkyl or aryl residue. Such polymers may in particular be produced according to methods which are described in German patent DE 42 21 381 and German patent application DE 43 00 772 and generally have a relative molecular mass of between 1,000 and 200,000. Further preferred copolymers are those which are described in German patent applications DE 43 03 320 and DE 44 17 734 and preferably comprise acrolein and acrylic acid/acrylic acid salts or vinyl acetate as monomers. The organic builder substances may be used, in particular for producing liquid products, in the form of aqueous solutions, preferably in the form of 30 to 50 wt. % aqueous solutions. All the stated acids are generally used in the form of the water-soluble salts, in particular the alkali metal salts, thereof.

Such organic builder substances may, if desired, be present in quantities of up to 40 wt. %, in particular of up to 25 wt. % and preferably of 1 wt. % to 8 wt. %. Quantities close to the stated upper limit are preferably used in pasty or liquid, in particular water-containing, products according to the invention.

Water-soluble inorganic builder materials which may in particular be considered are alkali metal silicates, alkali metal carbonates and alkali metal phosphates, which may be present in the form of the alkaline, neutral or acidic sodium or potassium salts thereof. Examples of these are trisodium phosphate, tetrasodium diphosphate, disodium dihydrogendiphosphate, pentasodium triphosphate, "sodium hexametaphosphate", oligomeric trisodium phosphate with degrees of oligomerization of 5 to 1000, in particular 5 to 50, and the corresponding potassium salts or mixtures of sodium and potassium salts. Water-insoluble, water-dispersible inorganic builder materials which are used are in particular crystalline or amorphous alkali metal aluminosilicates, in quantities of up to 50 wt. %, preferably of no more than 40 wt. % and, in liquid products, in particular from 1 wt. % to 5 wt. %. Preferred such materials are crystalline sodium aluminosilicates of washing product grade, in particular zeolite A, P and optionally X, alone or in mixtures, for example in the form of a co-crystallization product of zeolites A and X (Vegobond® AX, a commercial product of Condea Augusta S.p.A.). Quantities close to the stated upper limit are preferably used in solid, particulate products. Suitable aluminosilicates in particular comprise no particles with a grain size of above 30 μm and preferably consist to an extent of at least 80 wt. % of particles with a size below 10 μm. Their calcium binding capacity, which may be determined as stated in German patent DE 24 12 837, is generally in the range from 100 to 200 mg of CaO per gram.

Suitable substitutes or partial substitutes for the stated aluminosilicates are crystalline alkali metal silicates, which may be present alone or mixed with amorphous silicates. The alkali metal silicates usable as builders in the products according to the invention preferably have a molar ratio of alkali metal oxide to $SiO_2$ of below 0.95, in particular of 1:1.1 to 1:12 and may be in amorphous or crystalline form. Preferred alkali metal silicates are sodium silicates, in particular amorphous sodium silicates, with an $Na_2O:SiO_2$ molar ratio of 1:2 to 1:2.8. Those with an $Na_2O:SiO_2$ molar ratio of 1:1.9 to 1:2.8 may be produced in accordance with the method of European patent application EP 0 425 427. Preferably used crystalline silicates, which may be present alone or mixed with amorphous silicates, are crystalline phyllosilicates of the general formula $Na_2Si_xO_{2x+1}.yH_2O$, in which x, or "modulus", is a number from 1.9 to 22, in particular 1.9 to 4 and y is a number from 0 to 33 and preferred values for x are 2, 3 or 4. Crystalline phyllosilicates which fall within this general formula are described, for example, in European patent application EP 0 164 514. Preferred crystalline phyllosilicates are those in which x in the stated general formula assumes the values 2 or 3.

In particular, both β- and δ-sodium disilicates ($Na_2Si_2O_5.yH_2O$) are preferred, it being possible to obtain β-sodium disilicate for example by the method described in international patent application WO 91/08171. δ-Sodium silicates with a modulus of between 1.9 and 3.2 may be produced according to Japanese patent applications JP 04/238 809 or JP 04/260 610. Virtually anhydrous crystalline alkali metal silicates of the above-stated general formula in which x means a number from 1.9 to 2.1, which are produced from amorphous alkali metal silicates and may be produced as described in European patent applications EP 0 548 599, EP 0 502 325 and EP 0 452 428, may be used in products according to the invention. A crystalline sodium phyllosilicate with a modulus of 2 to 3, as may be produced from sand and soda by the method of European patent application EP 0 436 835 is used in a further preferred embodiment of products according to the invention. Crystalline sodium silicates with a modulus in the range from 1.9 to 3.5, as are obtainable by the method of European patent EP 0 164 552 and/or EP 0 294 753, are used in a further preferred embodiment of products according to the invention. Crystalline layered silicates of the above-stated formula (I) are distributed by Clariant GmbH under the trade name Na-SKS, for example Na-SKS-1 ($Na_2Si_{22}O_{45}\times H_2O$, kenyaite), Na-SKS-2 ($Na_2Si_{14}O_{29}\times H_2O$, magadiite), Na-SKS-3 ($Na_2Si_8O_{17}\times H_2O$) or Na-SKS-4 ($Na_2Si_4O_9\times H_2O$, makatite). Suitable representatives of these are primarily Na-SKS-5 (α-$Na_2Si_2O_5$), Na-SKS-7 (β-$Na_2Si_2O_5$, natrosilite), Na-SKS-9 ($NaHSi_2O_5.3H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 (δ-$Na_2Si_2O_5$). The articles published, for example, in "Hoechst High Chem Magazin 14/1993" on pages 33-38 and in "Seifen-Öle-Fette-Wachse, vol. 116, no. 20/-1990" on pages 805-808 provide an overview of crystalline phyllosilicates In a preferred development of products according to the invention, a granular compound is used which is prepared from crystalline phyllosilicate and citrate, from crystalline phyllosilicate and above-stated (co)polymeric polycarboxylic acid, as described for example in German patent application DE 198 19 187, or from alkali metal silicate and alkali metal carbonate, as is for example described in international patent application WO 95/22592 or is commercially available for example under the name Nabion® 15.

Builder substances are preferably present in the products according to the invention in quantities of up to 75 wt. %, in particular of 5 wt. % to 50 wt. %.

Peroxy compounds suitable for use in products according to the invention which may in particular be considered are organic peracids or peracid salts of organic acids, such as phthalimidopercaproic acid, perbenzoic acid or salts of diperdodecanedioic acid, hydrogen peroxide and inorganic salts which release hydrogen peroxide under washing conditions, which latter include perborate, percarbonate, persilicate and/or persulfate such as caroate. Where solid peroxy compounds are to be used, they may be used in the form of powders or granules, which may also in principle be encapsulated in known manner. If a product according to the invention contains peroxy compounds, these are preferably present in quantities of up to 50 wt. %, in particular of 5 wt. % to 30 wt. %. It may be appropriate to add relatively small quantities of known bleaching agent stabilizers, such as for example phosphonates, borates or metaborates and metasilicates and magnesium salts such as magnesium sulfate.

Bleaching activators which may be used are compounds which, under perhydrolysis conditions, yield aliphatic peroxycarboxylic acids with preferably 1 to 10 C atoms, in particular 2 to 4 C atoms, and/or optionally substituted perbenzoic acid. Suitable substances are those which bear O- and/or N-acyl groups having the stated number of C atoms and/or optionally substituted benzoyl groups. Preferred substances are repeatedly acylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenol-sulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and enol esters and acetylated sorbitol and mannitol known from German patent applications DE 19616 693 and DE 19616 767, or the mixtures thereof (SORMAN) described in European patent application EP 0 525 239, acylated sugar derivatives, in particular pentaacetyl glucose (PAG), pentaacetyl fructose, tetraacetyl xylose and octaacetyl lactose and acetylated, optionally N-alkylated glucamine and gluconolactone, and/or N-acylated lactams, for example N-benzoylcaprolactam, which are known from international patent applications WO 94/27970, WO 94/28102, WO 94/28103, WO 95/00626, WO 95/14759 and WO 95/17498. The hydrophilically substituted acyl acetals known from German patent application DE 19616 769 and the acyl lactams described in German patent application DE 19616 770 and international patent application WO 95/14075 are likewise preferably used. The combinations of conventional bleaching activators known from German patent application DE 44 43 177 may also be used. Such bleaching activators may be present, in particular in the presence of the above-stated hydrogen peroxide-releasing bleaching agents, in a conventional quantity range, preferably in quantities of 0.5 wt. % to 10 wt. %, in particular 1 wt. % to 8 wt. %, relative to the entire product, but are preferably entirely absent when percarboxylic acid is used as the sole bleaching agent.

In addition to or instead of the above listed conventional bleaching activators, the sulfone imines known from European patents EP 0 446 982 and EP 0 453 003 and/or bleach-boosting transition metal salts or transition metal complexes may be present as "bleach catalysts".

Enzymes usable in the products which may be considered are those from the class of amylases, proteases, lipases, cutinases, pullulanases, hemicellulases, cellulases, oxidases, laccases and peroxidases and mixtures thereof. Particularly suitable enzymatic active ingredients are those obtained from fungi or bacteria, such as *Bacillus subtilis, Bacillus licheniformis, Bacillus lentus, Streptomyces griseus, Humicola lanuginosa, Humicola insolens, Pseudomonas pseudoalcaligenes, Pseudomonas cepacia* or *Coprinus cinereus*. The enzymes may, as for example described in European patent EP 0 564 476 or in international patent application WO 94/23005, be adsorbed onto carrier substances and/or be embedded in encapsulating substances in order to protect them from premature inactivation. They are present in the washing or cleaning products according to the invention preferably in quantities of up to 5 wt. %, in particular of 0.2 wt. % to 4 wt. %. If the product according to the invention contains protease, it preferably exhibits a proteolytic activity in the range from approx. 100 PU/g to approx. 10,000 PU/g, in particular 300 PU/g to 8000 PU/g. If two or more enzymes are to be used in the product according to the invention, this may be achieved by incorporating the two or more separate enzymes or enzymes which are separately formulated in known manner or by two or more enzymes jointly formulated in a granular product, as is known, for example, from international patent applications WO 96/00772 or WO 96/00773.

Organic solvents other than water which may be used in the products according to the invention, in particular if these are in liquid or pasty form, include alcohols with 1 to 4 C atoms, in particular methanol, ethanol, isopropanol and tert.-butanol, diols with 2 to 4 C atoms, in particular ethylene glycol and propylene glycol, and mixtures thereof and the ethers derivable from the stated classes of compounds. Such water-miscible solvents are preferably present in the products according to the invention in quantities of no more than 30 wt. %, in particular of 6 wt. % to 20 wt. %.

In order to establish a desired pH value which is not automatically obtained by mixing the remaining components, the products according to the invention may contain acids which are compatible with the system and are environmentally compatible, in particular citric acid, acetic acid, tartaric acid, malic acid, lactic acid, glycolic acid, succinic acid, glutaric acid and/or adipic acid, as well as mineral acids, in particular sulfuric acid, or bases, in particular ammonium or alkali metal hydroxides. Such pH regulators are present in the products according to the invention in quantities of preferably no more than 20 wt. %, in particular of 1.2 wt. % to 17 wt. %.

Graying inhibitors have the task of keeping dirt which has been dissolved away from the textile fibers suspended in the liquor. Water-soluble colloids of a mainly organic nature are suitable for this purpose, for example starch, size, gelatin, salts of ether carboxylic acids or ether sulfonic acids of starch or cellulose or salts of acidic sulfuric acid esters of cellulose or starch. Water-soluble polyamides containing acidic groups are also suitable for this purpose. Derivatives of starch other than those stated above, for example aldehyde starches, may further be used. Cellulose ethers, such as carboxymethylcellulose (Na salt), methylcellulose, hydroxyalkylcellulose and mixed ethers, such as methylhydroxyethylcellulose, methylhydroxypropyl-cellulose, methylcarboxymethylcellulose and mixtures thereof, are preferably used, for example in quantities of 0.1 to 5 wt. %, relative to the product.

Textile washing products according to the invention may for example contain derivatives of diaminostilbene disulfonic acid or the alkali metal salts thereof as optical brighteners, although they preferably contain no optical brightener for use as a color washing product. Suitable compounds are, for example, salts of 4,4'-bis(2-anilino-4-morpholino-1,3,5-triazinyl-6-amino)-stilbene 2,2'-disulfonic acid or compounds of similar structure which, instead of the morpholino group, bear a diethanolamino group, a methylamino group, an anilino group or a 2-methoxyethylamino group. Brighteners of the substituted diphenylstyryl type may furthermore be present, for example the alkali metal salts of 4,4'-bis(2-sulfostyryl)-diphenyl, 4,4'-bis(4-chloro-3-sulfostyryl)-diphenol, or 4-(4-chlorostyryl)-4'-(2-sulfostyryl)-diphenyl. Mixtures of the above-stated optical brighteners may also be used.

Especially for use in machine washing, it may be advantageous to add conventional foam inhibitors to the products. Suitable foam inhibitors are, for example, soaps of natural or synthetic origin, which comprise an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bistearylethylenediamides. Mixtures of different foam inhibitors are also advantageously used, for example mixtures of silicones, paraffins or waxes. The foam inhibitors, in particular foam inhibitors containing silicone and/or paraffin, are preferably bound to a granular carrier substance which is soluble or dispersible in water. Mixtures of paraffins and bistearylethylenediamide are particularly preferred here.

The production of solid products according to the invention presents no difficulties and may proceed in known manner, for example by spray drying or granulation, with enzymes and any further thermally sensitive constituents such as for example bleaching agents optionally subsequently being separately added. Products according to the invention with an elevated bulk density, in particular in the range from 650 g/l to 950 g/l, may preferably produced by a method comprising an extrusion step known from European patent EP 0 486 592. A further preferred production process using a granulation method is described in European patent EP 0 642 576.

Products according to the invention may preferably be produced in the form of tablets, which may be monophasic or multiphasic, single-colored or multicolored and in particular consist of one layer or of two or more, in particular two, layers, by mixing together all the ingredients, optionally for each layer, in a mixer and compression molding the mixture by means of conventional tablet presses, for example eccentric presses or rotary presses, with pressing forces in the range from approx. 50 to 100 kN, preferably at 60 to 70 kN. In particular in the case of multilayer tablets, it may be advantageous for at least one layer to be preliminarily compression molded. This is preferably carried out at pressing forces of between 5 and 20 kN, in particular at 10 to 15 kN. In this manner, breaking-resistant tablets are straightforwardly obtained which nevertheless dissolve sufficiently rapidly under conditions of use and exhibit breaking and flexural strength values usually of 100 to 200 N, but preferably of above 150 N. A tablet produced in this manner is preferably of a weight of 10 g to 50 g, in particular of 15 g to 40 g. The tablets may be of any desired three-dimensional shape and may be round, oval or polygonal, intermediate shapes also being possible. Corners and edges are advantageously rounded. Round tablets preferably have a diameter of 30 mm to 40 mm. In particular the size of polygonal or cuboidal tablets, which are predominantly introduced by means of the dispenser for example of a dishwashing machine, is dependent on the geometry and volume of this dispenser. Preferred embodiments have, for example, a base area of (20 to 30 mm)×(34 to 40 mm), in particular of 26×36 mm or of 24×38 mm.

Liquid or pasty products according to the invention in the form of solutions containing conventional solvents are generally produced by simply mixing the constituents, which may be introduced into an automatic mixer as an undissolved material or as a solution.

EXAMPLES

Example 1

Production of N,N'-bis-[2-chloro-4(sulfonaphth-1-yl-amino)-triazin-6-yl]-1,2-diaminoethane Cyanuric chloride (8.26 g, 0.044 mol), suspended in a mixture of ice and acetone (50 ml), was added at 0° C. to a stirred aqueous solution of 4-aminonaphthalene-1-sulfonic acid (10.1 g, 0.044 mol). The mixture was stirred at pH 4.5 to 5 (established with sodium carbonate) and 0 to 5° C. for 5 hours and was thereafter heated to 20° C. within 1 hour. 75% ethylenediamine (1.78 g, 0.022 mol) was added and the mixture was stirred for 16 hours at 30° C. and pH 8.5 (established with NaOH). Phosphate buffer mixture (pH 6.5) and thereafter acetone (1.5 l) were added. The precipitated colorless solid was separated (yield 10.9 g, 53.8% purity).

Example 2

Production of N,N'-bis-[2-chloro-4-(1,5-disulfonaphth-2-yl-amino)-triazin-6-yl]-1,2-diaminoethane 2-Aminonaphthalene-1,5-disulfonic acid (77%, 20 g, 0.051 mol) was reacted with 1 mole equivalent of cyanuric chloride and 0.5 mole equivalents of ethylenediamine under the conditions described in Example 1. Acetone was added with stirring and the precipitated product was separated (yield 23 g, 64% purity).

Example 3

Production of N,N'-bis-[2-chloro-4-(3,6,8-trisulfonaphth-2-yl-amino)-triazin-6-yl]-1,2-diaminoethane Cyanuric chloride (3.24 g, 0.018 mol), suspended in a mixture of ice and acetone (50 ml), was added at 0° C. to a stirred aqueous solution of 2-aminonaphthalene-3,6,8-trisulfonic acid (66.5%, 10 g, 0.017 mol). The mixture was stirred at pH 5 to 5.5 (established with sodium carbonate) and 0 to 5° C. for 5 hours and was thereafter heated to 20° C. within 1 hour. 75% ethylenediamine (0.70 g, 0.009 mol) was added and the mixture was stirred for 18 hours at 30° C. and pH 8 to 8.5 (established with NaOH). Phosphate buffer mixture (pH 6.5) and thereafter acetone were added. The precipitated colorless solid was separated (yield 4.14 g, 51% purity).

Example 4

Production of 4,4'-bis-(2,4-dichlorotriazin-6-ylamino)-stilbene-2,2'-disulfonic acid Cyanuric chloride (20.2 g, 0.109 mol), suspended in a mixture of ice and acetone (80 ml), was added at 0° C. to a stirred solution of 4,4'-diaminostilbene-2,2'-disulfonic acid (20 g, 0.054 mol) in 200 ml of water. The mixture was stirred at pH 5 to 5.5 (established with sodium carbonate) and 0 to 5° C. for 6 hours, was thereafter heated to 20° C. and stirred for a further 2 hours at this temperature. The resultant solution was directly further reacted in Examples 5 to 7.

Example 5

Production of 4,4'-bis-[2-chloro-4-(4-sulfonaphth-1-ylamino)triazin-6-ylamino]-stilbene-2,2'-disulfonic acid An aqueous solution of 1-aminonaphthalene-4-sulfonic acid (0.012 mol) was added to the freshly produced solution according to Example 4 of 4,4'-bis-(2,4-dichlorotriazin-6-ylamino)-stilbene-2,2'-disulfonic acid (0.006 mol). The mixture was stirred at pH 5.5 and 20° C. for 24 hours.

Example 6

Production of 4,4'-bis-[2-chloro-4-(1,5-disulfonaphth-2-ylamino)triazin-6-ylamino]-stilbene-2,2'-disulfonic acid 4,4'-Bis-(2,4-dichlorotriazin-6-ylamino)-stilbene-2,2'-disulfonic acid was reacted with 2-aminonaphthalene-1,5-disulfonic acid in a similar manner to Example 5.

Example 7

Production of 4,4'-bis-[2-chloro-4-(3,6,8-trisulfonaphth-2-yl-amino-)triazin-6-ylamino]-stilbene-2,2'-disulfonic acid 4,4'-Bis-(2,4-dichlorotriazin-6-ylamino)-stilbene-2,2'-disulfonic acid was reacted with 2-aminonaphthalene-3,6,8-trisulfonic acid in a similar manner to Example 5.

Example 8

Dye Transfer Inhibition

Method: The sulfonated triazine derivatives produced according to the preceding Examples 1 to 3 and 5 to 7 were in each case forcibly applied onto white cotton textiles by immersion using an aqueous solution and the white textile was then washed in the presence of a dyed textile (Cibacron® Navy LS-G) at 60° C. with a powder washing product. Staining of the white textile was visually assessed by an experienced panel and rated on a scale from 1 (=severely stained) to 5 (=no discernible staining).

Result: The white textiles were not stained (ratings 4 to 5), the washed-out color remained entirely in the liquor.

The invention claimed is:

1. A washing product comprising a surfactant and a dye transfer inhibitor selected from the group consisting of triazine derivatives of the general formulae I, II, III and combinations thereof:

$$T(NH—Ar(SO_3Na)_a)_bHal_c \quad (I)$$

$$X(NH\text{-}T(NH—Ar(SO_3Na)_a)_eHal_f)_2 \quad (II)$$

$$X(NH\text{-}T(NH—Ar(SO_3Na)_d—NH\text{-}T(NH—Ar(SO_3Na)_a)Hal)Hal)_2 \quad (III)$$

wherein the product comprises at least one triazine derivative of the general formulae II, wherein T represents a 1,3,5-triazinyl residue; each Ar independently represents a naphthalene or benzene moiety; X represents a divalent hydrocarbyl moiety selected from the group consisting of linear or branched $C_{1-20}$ hydrocarbon groups which optionally may include one or more —N(H)— carbon chain interruptions, stilbene groups and biphenyl groups which optionally may be mono- or poly-$SO_3Na$-substituted; each Hal independently represents a halogen selected from the group consisting of chlorine, bromine, and iodine; each of a and d independently represents 1, 2 or 3; b and c each represent 1 or 2 such that b+c=3; e represents 1 or 2 and f represents 0 or 1 such that e+f=2; and wherein the triazinyl residue substituents are located at the 2, 4 and 6 positions of the 1,3,5-triazinyl residue;

and wherein the triazine derivative of the general formula II is prepared by a process comprising reacting two equivalents of a triazine derivative of the general formula I with one equivalent of an amino compound selected from the group consisting of $C_{1-20}$ diaminoalkanes, diaminostilbenes, diaminobiphenyls, and mixtures thereof;

wherein the amino compound comprises a diaminoalkane selected from the group consisting of oligo-ethyleneimines and poly-ethyleneimines of the general formula $NH_2—CH_2CH_2—(NH—CH_2CH_2—)_nNH_2$, wherein n represents a number of 1 to 9.

2. The washing product of claim 1, wherein X represents a linear or branched $C_{2-12}$ hydrocarbon group.

3. The washing product of claim 1, wherein the dye transfer inhibitor comprises a triazine derivative of the general formula I prepared by a process comprising reacting a 2,4,6-trihalo-1,3,5-triazine with 1 or 2 equivalents of an aminoaryl compound selected from the group consisting of 2-aminobenzenesulfonic acid, 3-aminobenzenesulfonic acid, 4-aminobenzenesulfonic acid, 2-amino-1,3-benzenedisulfonic acid, 4-amino-1,3-benzenedisulfonic acid, 2-amino-1,3,5-benzenetrisulfonic acid, 2-amino-1-naphthalenesulfonic acid, 2-amino-1,5-naphthalenedisulfonic acid, 7-amino-1,6-naphthalenedisulfonic acid, 7-amino-1,3,6-naphthalenetrisulfonic acid, and mixtures thereof, wherein the sulfonic acid groups are present in salt form.

4. The washing product of claim 1, wherein n of the general formula $NH_2—CH_2CH_2—(NH—CH_2CH_2—)_nNH_2$ represents a number of 2 to 5.

5. The washing product of claim 1, wherein the amino compound comprises a sulfonic acid salt substituted diaminostilbene, a sulfonic acid salt substituted diaminobiphenyl, or mixtures thereof.

6. The washing product of claim 1, wherein the dye transfer inhibitor comprises a triazine derivative of the general formula III prepared by a process comprising reacting an amino compound selected from the group consisting of diaminostilbenes, diaminobiphenyls, and mixtures thereof with 2 equivalents of a 2,4,6-trihalo-1,3,5-triazine to form an intermediate, reacting the intermediate with a diaminoaryl compound to form a second intermediate, reacting the second intermediate with 2 equivalents of a second 2,4,6-trihalo-1,3,5-triazine to form a third intermediate, and reacting the third intermediate with 2 equivalents of an aminoaryl compound.

7. The washing product of claim 1, wherein the dye transfer inhibitor is present in an amount of 0.1 to 2 wt. %.

8. The washing product according to claim 3, wherein the dye transfer inhibitor is present in an amount of 0.1 to 2 wt. %.

9. The washing product according to claim 6, wherein the dye transfer inhibitor is present in an amount of 0.1 to 2 wt. %.

10. The washing product of claim 1, wherein the dye transfer inhibitor is present in an amount of 0.2 to 1 wt. %.

11. The washing product of claim 1, further comprising one or more polymers selected from the group consisting of vinylpyrrolidones, vinylimidazoles, vinylpyridine N-oxides, and copolymers thereof.

12. A method comprising:

(a) providing a dyed textile to be washed; and (b) contacting the dyed textile with the washing product of claim 1 in an aqueous solution.

13. The method of claim 12, wherein the aqueous solution further comprises one or more surfactants.

14. The washing product of claim 1, wherein b=2 and c=1.

* * * * *